US007520582B2

(12) United States Patent
Konno

(10) Patent No.: US 7,520,582 B2
(45) Date of Patent: Apr. 21, 2009

(54) IMAGE FORMING APPARATUS AND METHOD

(75) Inventor: Masaaki Konno, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 368 days.

(21) Appl. No.: 11/235,142

(22) Filed: Sep. 27, 2005

(65) Prior Publication Data

US 2006/0066653 A1 Mar. 30, 2006

(30) Foreign Application Priority Data

Sep. 28, 2004 (JP) ..... 2004-282648

(51) Int. Cl.
*B41J 29/38* (2006.01)

(52) U.S. Cl. ..... 347/14; 347/15

(58) Field of Classification Search ..... 347/14, 347/21, 95, 15, 19, 43
See application file for complete search history.

(56) References Cited

U.S. PATENT DOCUMENTS 5,838,342 A 11/1998 Takahashi et al.
6,158,856 A * 12/2000 Sato et al. ..... 347/101
6,267,476 B1 * 7/2001 Kato et al. ..... 347/100
6,386,673 B1 5/2002 Takahashi et al.
6,467,891 B2 10/2002 Moriyama et al.
6,834,947 B2 * 12/2004 Moriyama et al. ..... 347/19
2002/0015085 A1 2/2002 Moriyama et al.
2006/0284913 A1 * 12/2006 Takanose et al. ..... 347/15

FOREIGN PATENT DOCUMENTS

JP 6-91998 A 4/1994
JP 10-226055 A 8/1998
JP 2000-127275 A 5/2000
JP 2001-138494 A 5/2001
JP 2001138494 A 5/2001
WO WO-03/043825 A1 5/2003

* cited by examiner

*Primary Examiner*—Thinh H Nguyen
(74) *Attorney, Agent, or Firm*—Birch, Stewart, Kolasch & Birch, LLP

(57) ABSTRACT

The image forming apparatus comprises: a first liquid ejection device which ejects droplets of a first liquid; a second liquid ejection device which ejects droplets of a second liquid; and a liquid volume ratio control device which controls a liquid volume ratio of the first liquid and the second liquid ejected from the first liquid ejection device and the second liquid ejection device, according to an image formed on a recording medium by the droplets of the first liquid and the second liquid on the recording medium.

18 Claims, 11 Drawing Sheets

A: WIDTH -DISTANCE BETWEEN R60 VALUES ON EITHER SIDE OF LINE
B: BLUR -DISTANCE FROM R10 TO R90
C: RAG -STANDARD DEVIATION OF DIVERGENCE FROM FITTING LINE AT R60
D: CONTRAST -(Rmax - Rmin) / Rmax
E: DARKNESS -AVERAGE OPTICAL DENSITY WITHIN RANGE BORDERED BY R75 VALUES
F: FILL -(SURFACE AREA OF R75 OR ABOVE) / (TOTAL SURFACE AREA OF R95 OR BELOW)

IMAGE FORMING APPARATUS AND METHOD

BACKGROUND OF THE INVENTION

1. Field of the Invention

The present invention relates to an image forming apparatus and method, and more particularly, to image forming technology suitable for an image forming apparatus, such as an inkjet recording apparatus which forms images on a recording medium by ejecting liquid droplets from nozzles.

2. Description of the Related Art

Japanese Patent Application Publication No. 6-91998 discloses an image output apparatus having a plurality of print heads, in which a test image is formed, and a correctional device is provided which corrects the drive signals of a plurality of print heads jointly, on the basis of the results of reading the test image.

Japanese Patent Application Publication No. 2000-127375 discloses technology for performing print position adjustment processing in a recording apparatus which performs printing using a recording treatment liquid and a recording liquid, by forming a pattern in which the relative print positions of a recording print 1 and a recording print 2 are staggered, and then measuring the reflected light densities of the plurality of patterns.

Japanese Patent Application Publication No. 10-226055 discloses an inkjet recording apparatus having a control device which varies at least one of the ink ejection volume and the treatment liquid ejection volume, between a pre-processing section which forms ink dots after forming treatment liquid dots, and a post-processing section which forms treatment liquid dots after forming ink dots.

Since the wetting properties, permeability, and the like of treatment liquid and recording liquid vary between different types of recording medium (media), the optimal liquid volume of the respective liquids, and the optimal combination ratio (liquid volume ratio) also varies. However, in Japanese Patent Application Publication No. 6-91998, there is no disclosure with regard to respectively optimizing the control conditions of the head for treatment liquid and the control conditions of the head for recording liquid. Furthermore, the problem resolved by the technology described in Japanese Patent Application Publication No. 2000-127375 is that of aligning the print positions between a plurality of recording heads, and there is no disclosure regarding the ratio of the liquid volumes of the treatment liquid and the recording liquid.

Japanese Patent Application Publication No. 10-226055 discloses technology which controls and varies the ejection volumes of recording liquid or treatment liquid, when the droplet ejection sequence of treatment liquid and recording liquid is changed, but it does not mention technology for correcting the droplet volume ratio and the combination ratio to optimal values, depending on the type of media used.

SUMMARY OF THE INVENTION

The present invention has been contrived in view of the foregoing circumstances, an object thereof being to provide an image forming apparatus and method capable of obtaining high-quality image output by adjusting the ejection volumes and the combination ratio of a plurality of types of liquids automatically to an optimal state, in accordance with the properties of the recording medium.

In order to attain the aforementioned object, the present invention is directed to an image forming apparatus, comprising: a first liquid ejection device which ejects droplets of a first liquid; a second liquid ejection device which ejects droplets of a second liquid; and a liquid volume ratio control device which controls a liquid volume ratio of the first liquid and the second liquid ejected from the first liquid ejection device and the second liquid ejection device, according to an image formed on a recording medium by the droplets of the first liquid and the second liquid on the recording medium.

According to the present invention, an image is formed on the recording medium by ejecting the first liquid and the second liquid respectively from the first liquid ejection device and the second liquid ejection device, and a value forming an indicator for evaluating image quality is measured from the information determined from the image. The liquid volume ratio control device judges the suitable liquid volume ratio of the first liquid and the second liquid, on the basis of these actual measurement results (the image determination results), and selects the ejection control conditions for the first liquid and second liquid. Accordingly, it is possible to select a suitable liquid volume ratio (combination ratio) with respect to various different types of recording media, and therefore high-quality image output can be achieved, irrespective of the type of recording medium.

In the composition of the image forming apparatus according to the present invention, a mode is possible in which an image determination device is provided for determining an image formed on the recording medium by ejecting droplets of the first and second liquid, and a mode is also possible in which the aforementioned image determination (measurement) operation is carried out previously, before shipping the apparatus, and optimal values (optimal data) for the liquid volume ratio relating to various combinations of the first liquid, second liquid and recording medium, are stored in advance in a storage device, such as a ROM. In the latter case, it is possible to omit the "image determination device" from the composition of the apparatus.

The first liquid ejection device and the second liquid ejection device may be constituted by separate ejection heads, or alternatively, the nozzles for ejecting the first liquid corresponding to the first liquid ejection device and the nozzles for ejecting the second liquid corresponding to the second liquid ejection device may be combined in a single ejection head.

The conditions relating to the ejection sequence of the first liquid and second liquid, the state of overlap of the deposited dots of the respective liquids (the relative positions of the dots), and the like, are not limited in particular, and various modes are possible in accordance with the combination of types of the first liquid and the second liquid.

Preferably, the second liquid is a recording liquid including a coloring material, and the first liquid is a treatment liquid having reactivity which causes a change of properties affecting at least one of permeation characteristics of the recording liquid into the recording medium and fixing characteristics of the coloring material onto the recording medium.

The present invention may be used suitably in an image forming apparatus which combines two types of liquids whereby fixing properties into the recording medium are increased by reaction between the treatment liquid and the recording liquid.

Preferably, the image forming apparatus further comprises: a medium type determination device which determines a type of the recording medium; and a liquid volume ratio storage device which stores information relating to the liquid volume ratio controlled by the liquid volume ratio control device, in association with information relating to the type of the recording medium obtained by the medium type determination device.

By storing control information for the liquid volume ratios determined on the basis of the image determination in the liquid volume ratio storage device, in association with information relating to the type of recording medium, it is possible to read in and use the information in the liquid volume ratio storage device, when a similar type of recording medium is used subsequently. By accumulating control information for liquid volume ratios relating to a plurality of types of recording medium, it is possible to adapt swiftly to a plurality of types of recording media.

Preferably, the image formed on the recording medium by depositing the droplets of the first liquid and the second liquid is a test pattern; and the image forming apparatus further comprises a test pattern droplet ejection control device which controls ejection of the droplets by the first liquid ejection device and the second liquid ejection device, in such a manner that the test pattern is printed.

By printing a test pattern and then reading in the results of the test pattern, separately from the target image (the main image) which is to be formed in accordance with the image data relating to a print request, it is possible readily to obtain information which is valuable for use in evaluating image quality.

Preferably, the test pattern is an image which includes a plurality of evaluation patches in which a droplet ejection volume of at least one of the first liquid and the second liquid is varied.

By forming a test pattern in which a plurality of evaluation patches of different droplet ejection conditions, and evaluating the image quality of the respective evaluation patches, it is possible to select the optimal conditions, readily. The arrangement of the evaluation patches on the recording medium is not limited in particular, but desirably, the evaluation patches are arranged in one row, or in a two-dimensional matrix, depending on the number of parameters and the respective values of the droplet ejection conditions which are varied.

Preferably, the plurality of evaluation patches are formed by ejecting droplets while varying a combination of ejection drive waveform, ejection drive frequency, and ejection nozzle pitch.

According to this mode, it is possible to form evaluation patches for selecting conditions with good efficiency, and hence the optimal conditions can be set readily.

Preferably, the image forming apparatus further comprises: an image determination device which determines an image formed on the recording medium by ejecting droplets of the first liquid and the second liquid, wherein the liquid volume ratio is controlled by the liquid volume ratio control device according to image determination results obtained by the image determination device.

By adopting an apparatus composition which comprises an image determination device, it is possible to adapt to many different combinations of the first liquid, second liquid and recording medium.

Preferably, the image forming apparatus further comprises: an evaluation value calculation device which calculates an evaluation value for judgment purposes by measuring at least two elements from among width, blur, rag, contrast, darkness and fill, from information obtained via the image determination device, and combining measurement results from at least two of the elements, wherein the liquid volume ratio control device specifies the liquid volume ratio according to the evaluation value calculated by the evaluation value calculation device.

Examples of indicators for evaluating image quality are the line width, blur, rag, contrast, darkness and fill. Desirably, numerical values are derived for these indicators on the basis of an image quality attribute measurement method conforming to ISO 13660, for example.

It is also possible to evaluate the respective measurement values converted into numeral values, independently, but desirably, an evaluation value for judgment purposes is defined by combining the measurement values for at least two items (factors), and hence a plurality of image attributes are judged conjointly. As a specific example, a mode is possible in which an evaluation value for judgment purposes is obtained by summing (in linear combination) the products obtained by multiplying the measurement values of the respective image quality attributes by prescribed weighting coefficients.

In order to attain the aforementioned object, the present invention is also directed to an image forming method, comprising the steps of: ejecting droplets of a first liquid from a first liquid ejection nozzle; ejecting droplets of a second liquid from a second liquid ejection nozzle; determining an image formed on a recording medium by the droplets of the first liquid and the second liquid; and controlling a liquid volume ratio of the first liquid and the second liquid ejected from the first liquid ejection nozzle and the second liquid ejection nozzle, according to image determination results obtained in the image determination step, wherein an image is formed on the recording medium by ejecting droplets of the first liquid and the second liquid from the first liquid ejection nozzle and the second liquid ejection nozzle according to conditions controlled in the liquid volume ratio control step and an input image data.

As a compositional example of an ejection head which ejects at least one of the first liquid and the second liquid, it is possible to use a full line type print head having a nozzle row in which a plurality of nozzles are arranged through a length corresponding to the full width of the recording medium.

In this case, a mode may be adopted in which a plurality of relatively short ejection head blocks having nozzles rows which do not reach a length corresponding to the full width of the recording medium are combined and joined together, thereby forming nozzle rows of a length that correspond to the full width of the recording medium.

A full line type ejection head is usually disposed in a direction perpendicular to the relative feed direction (relative conveyance direction) of the recording medium, but modes may also be adopted in which the ejection head is disposed following an oblique direction that forms a prescribed angle with respect to the direction perpendicular to the relative conveyance direction.

When forming color images, it is possible to provide full line type ejection heads for each color of a plurality of colored inks (recording liquids), or it is possible to eject recording liquids of a plurality of colors, from one ejection head.

The term "recording medium" indicates a medium on which an image is recorded by means of the action of the ejection head (this medium may also be called a print medium, image forming medium, image receiving medium, or the like). This term includes various types of media, irrespective of material and size, such as continuous paper, cut paper, sealed paper, resin sheets, such as OHP sheets, film, cloth, a printed circuit board on which a wiring pattern, or the like, is formed by means of an ejection head, and the like.

The conveyance device for causing the recording medium and the ejection head to move relative to each other may include a mode where the recording medium is conveyed with respect to a stationary (fixed) ejection head, or a mode where an ejection head is moved with respect to a stationary recording medium, or a mode where both the ejection head and the recording medium are moved.

According to the present invention, the image formation results obtained by the combination of the recording medium, first liquid and second liquid actually used, are determined, and by controlling the liquid volume ratio of the first liquid and the second liquid on the basis of these determination results, it is possible to select a suitable liquid volume ratio, and therefore, high-quality image output is possible, regardless of the type of recording medium.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
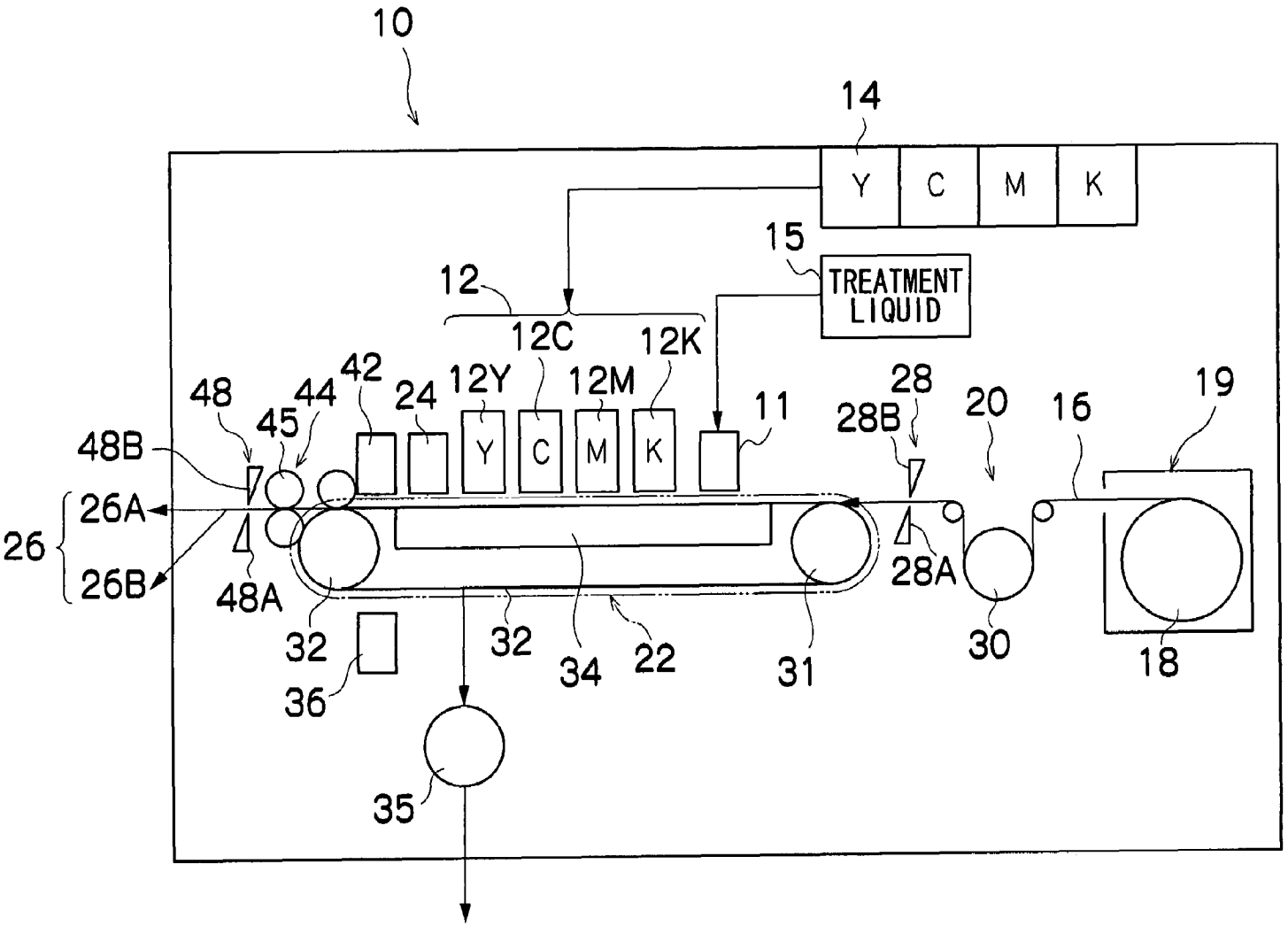
FIG. 1 is a general schematic drawing of an inkjet recording apparatus relating to an embodiment of the present invention.

FIG. 1 is a diagram of the general composition of an inkjet recording apparatus relating to an embodiment of the present invention. As shown in FIG. 1, the inkjet recording apparatus 10 comprises: a treatment liquid ejection head 11 (corresponding to a first liquid application device); a print unit 12 having a plurality of inkjet heads (corresponding to a second liquid ejection device, hereafter, called "print heads") 12K, 12M, 12C, and 12Y provided for colors of ink (corresponding to a second liquid) of black (K), magenta (M), cyan (C), and yellow (Y), respectively; an ink storing and loading unit 14 for storing inks of K, C, M and Y to be supplied to the print heads 12K, 12M, 12C and 12Y; a treatment liquid storing and loading unit 15 for storing treatment liquid to be supplied to the treatment liquid ejection head 11; a media supply unit 18 for supplying a recording medium 16; a decurling unit 20 removing curl in the recording medium 16; a suction belt conveyance unit 22 disposed facing the nozzle face (ink droplet ejection face) of the print unit 12, for conveying the recording medium 16 while keeping the recording medium 16 flat; a print determination unit 24 (corresponding to an image determination device) for reading the printed result produced by the printing unit 12; and an output unit 26 for outputting a recorded recording medium (printed matter) to the exterior.

The ink storing and loading unit 14 has ink tanks for storing the inks of K, M, C, and Y to be supplied to the heads 12K, 12M, 12C, and 12Y, and the tanks are connected to the heads 12K, 12M, 12C, and 12Y by means of prescribed channels. The ink storing and loading unit 14 has a warning device (for example, a display device or an alarm sound generator) for warning when the remaining amount of any ink is low, and has a mechanism for preventing loading errors among the colors.

The treatment liquid storing and loading unit 15 has a treatment liquid tank for storing treatment liquid, and the treatment liquid tank is connected to the treatment liquid ejection head 11 via necessary tubing channels. Furthermore, similarly to the ink storing and loading unit 14, the treatment liquid storing and loading unit 15, also comprises a warning device (for example, a display device or an alarm sound generator) for warning when the remaining amount of any treatment liquid is low, and has a mechanism for preventing loading errors among the treatment liquids.

The ink used in the present embodiment is, for instance, colored ink including anionic polymer, namely, a polymer containing negatively charged surface-active ions. Furthermore, the treatment liquid used in the present embodiment is, for instance, a transparent reaction promotion agent including cationic polymer, namely, a polymer containing positively charged surface-active ions.

When ink and treatment liquid are mixed, the insolubility and/or fixing reaction of the coloring material in the ink proceeds due to a chemical reaction. Here the term "insolubility" includes a phenomenon whereby the coloring material separates or precipitates from the solvent, a phenomenon whereby the liquid in which the coloring material is dissolved changes (coagulates) to a solid phase, or a phenomenon whereby the liquid increases in viscosity and hardens. Furthermore, the term "fixing" may indicate a mode where the coloring material is held on the surface of the recording medium 16, a mode where the coloring material permeates into the recording medium 16 and is held therein, or a mode combining these states.

The reaction speed and the characteristics of the respective liquids (surface tension, viscosity, or the like) can be adjusted by regulating the respective compositions of the ink and treatment liquids, the concentration of the materials contributing to the reaction, or the like, and desired ink insolubility and/or ink fixing properties (hardening speed, fixing speed, or the like) can be achieved. The physical conditions of the treatment liquids and the ink used in the present embodiment are described hereinafter.

As regards the supply system for the recording medium 16, in FIG. 1, a magazine 19 for rolled paper (continuous paper) is shown as an example of the media supply unit 18; however, a plurality of magazines with papers of different paper width and quality may be jointly provided. Moreover, paper (recording media) may be supplied in cassettes that contain cut papers loaded in layers and that are used jointly or in lieu of magazines for rolled papers.

In the case of a configuration in which a plurality of types of recording medium can be used, it is preferable that an information recording medium such as a bar code and a wireless tag containing information about the type of recording medium is attached to the magazine, and by reading the information contained in the information recording medium with a predetermined reading device, the type of recording medium (media type) to be used is automatically determined, and ejection is controlled so that the treatment liquids and ink droplets are ejected in an appropriate manner in accordance with the type of medium.

The recording medium 16 delivered from the media supply unit 18 retains curl due to having been loaded in the magazine 19. In order to remove the curl, heat is applied to the recording medium 16 in the decurling unit 20 by a heating drum 30 in the direction opposite from the curl direction in the magazine. The heating temperature at this time is preferably controlled so that the recording medium 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, of which length is not less than the width of the conveyor pathway of the recording medium 16, and a round blade 28B, which moves along the stationary blade 28A. The stationary blade 28A is disposed on the reverse side of the printed surface of the recording medium 16, and the round blade 28B is disposed on the printed surface side across the conveyor pathway. When cut papers are used, the cutter 28 is not required.

The decurled and cut recording medium 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording medium 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording medium 16 is held on the belt 33 by suction.

The belt 33 is driven in the counterclockwise direction in FIG. 1 by the motive force of a motor 88 (not shown in FIG. 1, but shown in FIG. 7) being transmitted to at least one of the rollers 31 and 32, which the belt 33 is set around, and the recording medium 16 held on the belt 33 is conveyed from right to left in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

Figure 2:
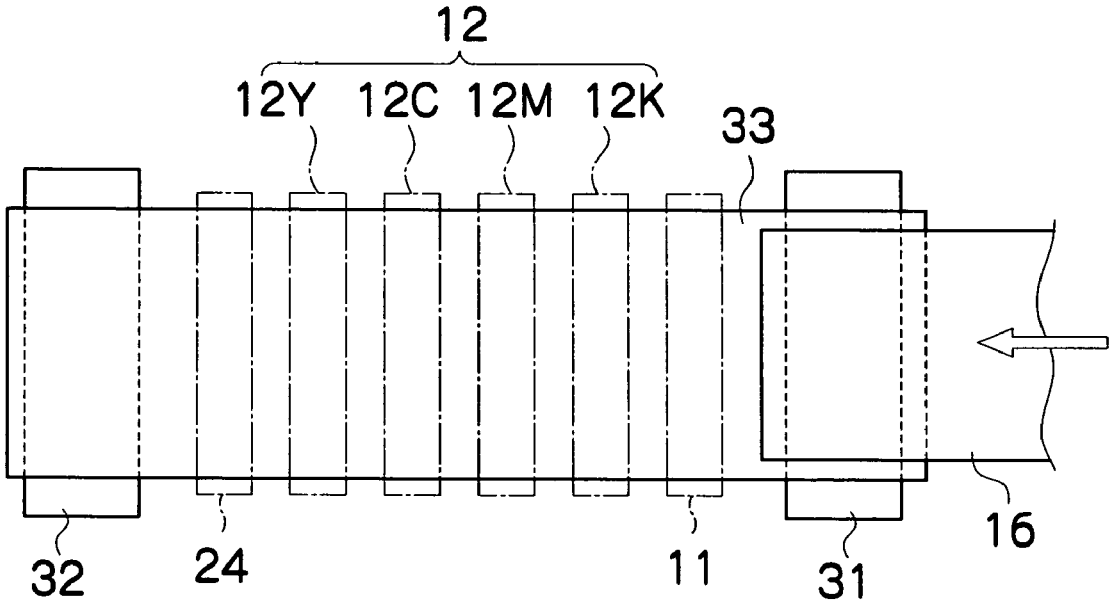
FIG. 2 is a plan view of the principal part of the peripheral area of a print unit in the inkjet recording apparatus shown in FIG. 1.

The treatment liquid ejection head 11 and the print heads 12K, 12M, 12C and 12Y of the print unit 12 are full line heads having a length corresponding to the maximum width of the recording medium 16 used with the inkjet recording apparatus 10 (see FIG. 2), and comprising nozzles for ejecting ink or nozzles for ejecting treatment liquid arranged on a nozzle face through a length exceeding at least one edge of the maximum-size recording medium (namely, the full width of the printable range).

The print heads 12K, 12M, 12C and 12Y of the print unit 12 are arranged in the sequence of the colors, black (K), magenta (M), cyan (C) and yellow (Y), from the upstream side, in the direction of conveyance of the recording medium 16, and the treatment liquid ejection head 11 is disposed further to the upstream side of the print unit 12. The print heads 11, 12K, 12M, 12C and 12Y are disposed in fixed positions in such a manner that they extend in a direction substantially perpendicular to the conveyance direction of the recording medium 16. By means of this head arrangement, it is possible to cause a treatment liquid to adhere to the print surface (recording surface) of the recording medium 16 by means of the treatment liquid ejection head 11, before ejecting colored inks from the print unit 12.

A color image can be formed on the recording medium 16 by ejecting inks of different colors from the heads 12K, 12M, 12C, and 12Y, respectively, onto the recording medium 16 while the recording medium 16 is conveyed by the suction belt conveyance unit 22.

By adopting a configuration in which the full line heads 12K, 12M, 12C, and 12Y having nozzle rows covering the full paper width are provided for the respective colors in this way, it is possible to record an image on the full surface of the recording medium 16 by performing just one operation of relatively moving the recording medium 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KMCY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

The print determination unit 24 includes an image sensor 132 (not shown in FIG. 1, but shown in FIG. 10) for capturing an image of the droplet ejection results of the print unit 12, functions as an image determination device for measuring the image quality attributes in order to evaluate bleeding from an image of droplets ejected in a two-dimensional fashion read in by the image sensor, and also functions as a device for determining nozzle blockages and other ejection defects.

A CCD area sensor in which a plurality of photoreceptor elements (photoelectric transducers) are two-dimensionally arranged on the light receiving surface is suitable for use as the print determination unit 24 of the present embodiment. An area sensor has an imaging range which is capable of capturing an image of at least the full area of the ink ejection width (image recording width) of the respective heads 12K, 12M, 12C and 12Y. It is possible to achieve the required imaging range by means of one area sensor, or alternatively, it is also possible to ensure the required imaging range by combining (joining) a plurality of area sensors. Alternatively, a composition may be adopted in which the area sensor is supported on a movement mechanism (not shown), and an image of the required imaging range is captured by moving (scanning) the area sensor.

Furthermore, it is also possible to use a line sensor instead of the area sensor. In this case, a desirable composition is one in which the line sensor has rows of photoreceptor elements (rows of photoelectric transducing elements) with a width that is greater than the ink droplet ejection width (image recording width) of the print heads 12K, 12M, 12C and 12Y As a further alternative, it is possible to adopt a composition in which an area sensor which functions as an image determination device for evaluating bleeding, and a line sensor which functions as a device for determining ejection defects, are provided jointly.

An image (actual image) in which a test pattern or the desired image is printed by at least one of the print heads 12K, 12M, 12C and 12Y in the print unit 12 is read in by the print determination unit 24, and evaluation of the print quality, such as the state of bleeding, and evaluation of the ejection from each head, is performed. The details of the method for evaluating print quality will be described hereinafter. Furthermore, the ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed object generated in this manner is output via the output unit 26. Desirably, the image which is actually to be printed, and the test print (print results of the test pattern) are output separately. In the inkjet recording apparatus 10 according to the present embodiment, a sorting device (not shown) is provided for switching the output path in order to sort the printed matter with the target print and the printed matter with the test print, and to send them to paper output units 26A and 26B, respectively.

If the main image and the test print are formed simultaneously in a parallel fashion, on a large piece of printing paper, then the portion corresponding to the test print is cut off by means of the cutter (second cutter) 48. The cutter 48 is disposed immediately in front of the output section 26, and it serves to cut and separate the main image from the test print section, in cases where a test image is printed onto the white margin of the image. The structure of the cutter 48 is similar to that of the first cutter 28 described previously, being constituted by a fixed blade 48B and a circular blade 48A.

Although not shown in FIG. 1, the paper output unit 26A for the target prints is provided with a sorter for collecting prints according to print orders.

Structure of Print Head

Next, the structure of a head will be described. The treatment liquid ejection head 11 and the heads 12K, 12M, 12C, and 12Y of the respective ink colors have the same structure, and a reference numeral 50 is hereinafter designated to any of the heads.

Figure 3A:
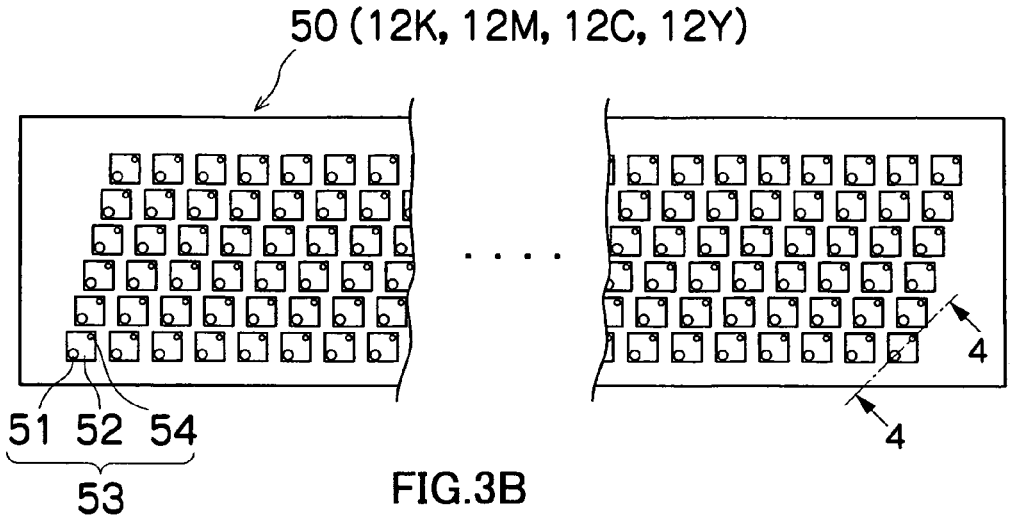
FIG. 3A is a plan view perspective diagram showing an example of the composition of a print head.
Figure 3B:
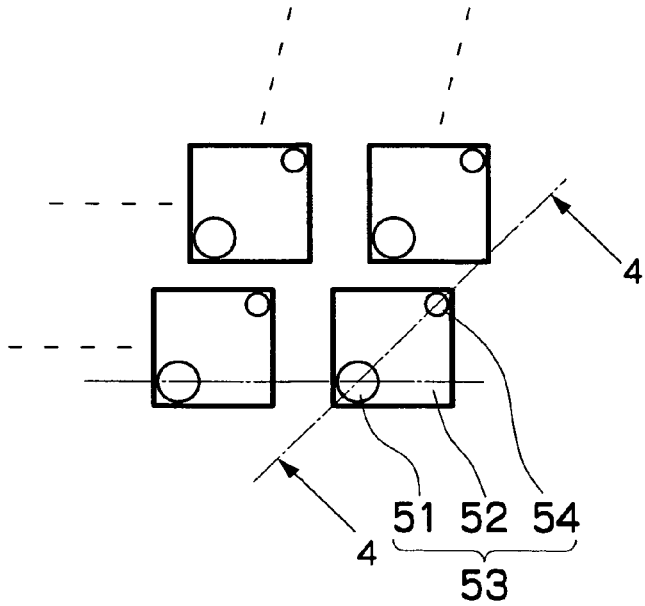
FIG. 3B is a principal enlarged view of FIG. 3A.
Figure 3C:
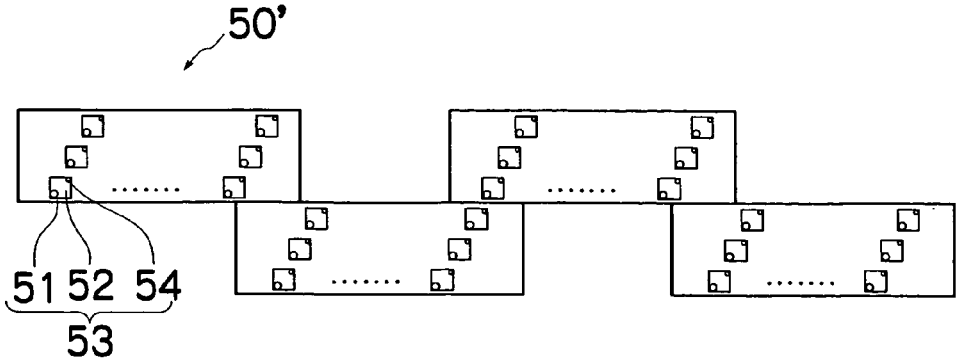
FIG. 3C is a plan view perspective diagram showing a further example of the composition of a full line head.
Figure 4:
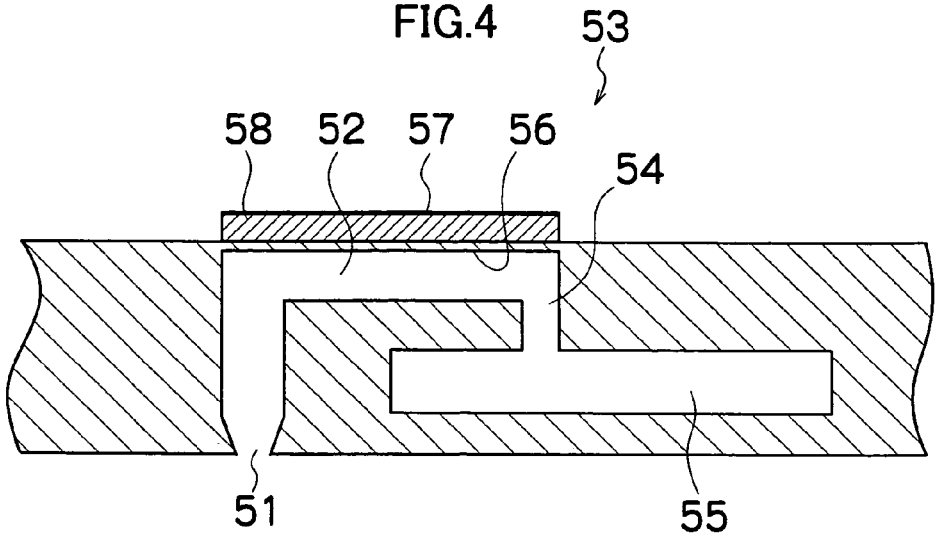
FIG. 4 is a cross-sectional view along line 4-4 in FIG. 3A.

FIG. 3A is a perspective plan view showing an example of the configuration of the head 50, FIG. 3B is an enlarged view of a portion thereof, FIG. 3C is a perspective plan view showing another example of the configuration of the head 50, and FIG. 4 is a cross-sectional view taken along the line 4-4 in FIGS. 3A and 3B, showing the inner structure of a droplet ejection element (an ink chamber unit for one nozzle 51).

The nozzle pitch in the head 50 should be minimized in order to maximize the density of the dots printed on the surface of the recording medium 16. As shown in FIGS. 3A and 3B, the head 50 according to the present embodiment has a structure in which an ink chamber unit (droplet ejection elements) 53, each comprising a nozzle 51 forming an ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

The mode of forming one or more nozzle rows through a length corresponding to the entire width of the recording medium 16 in a direction substantially perpendicular to the conveyance direction of the recording medium 16 is not limited to the example described above. For example, instead of the configuration in FIG. 3A, as shown in FIG. 3C, a line head having nozzle rows of a length corresponding to the entire width of the recording medium 16 can be formed by arranging and combining, in a staggered matrix, short head units 50' having a plurality of nozzles 51 arrayed in a two-dimensional fashion.

The planar shape of the pressure chamber 52 provided for each nozzle 51 of the print head 50 is substantially a square shape (see FIGS. 3A and 3B), and an ejection port connected to the nozzle 51 and an inlet for supplied ink (supply port) 54 are disposed in either corner on a diagonal line of the square. The shape of the pressure chamber 52 is not limited to that of the present embodiment and various modes are possible in which the planar shape is a quadrilateral shape (diamond shape, rectangular shape, or the like), a pentagonal shape, a hexagonal shape, or other polygonal shape, or a circular shape, elliptical shape, or the like.

As shown in FIG. 4, each pressure chamber 52 is connected to a common channel 55 through the supply port 54. The common channel 55 is connected to an ink tank 60 (not shown in FIG. 4, but shown in FIG. 6), which is a base tank that supplies ink, and the ink supplied from the ink tank 60 is delivered through the common flow channel 55 in FIG. 4 to the pressure chambers 52.

An actuator 58 provided with an individual electrode 57 is bonded to a pressure plate 56 (a diaphragm that also serves as a common electrode) which forms the ceiling of the pressure chamber 52. When a drive voltage is applied to the individual electrode 57, the actuator 58 deforms, thereby changing the volume of the pressure chamber 52. This causes a pressure change which results in ink being ejected from the nozzle 51. When ink is ejected, new ink is supplied to the pressure chamber 52 from the common flow channel 55 through the supply port 54. A piezoelectric body, such as a piezo element, is suitable for use as the actuator 58.

Figure 5:
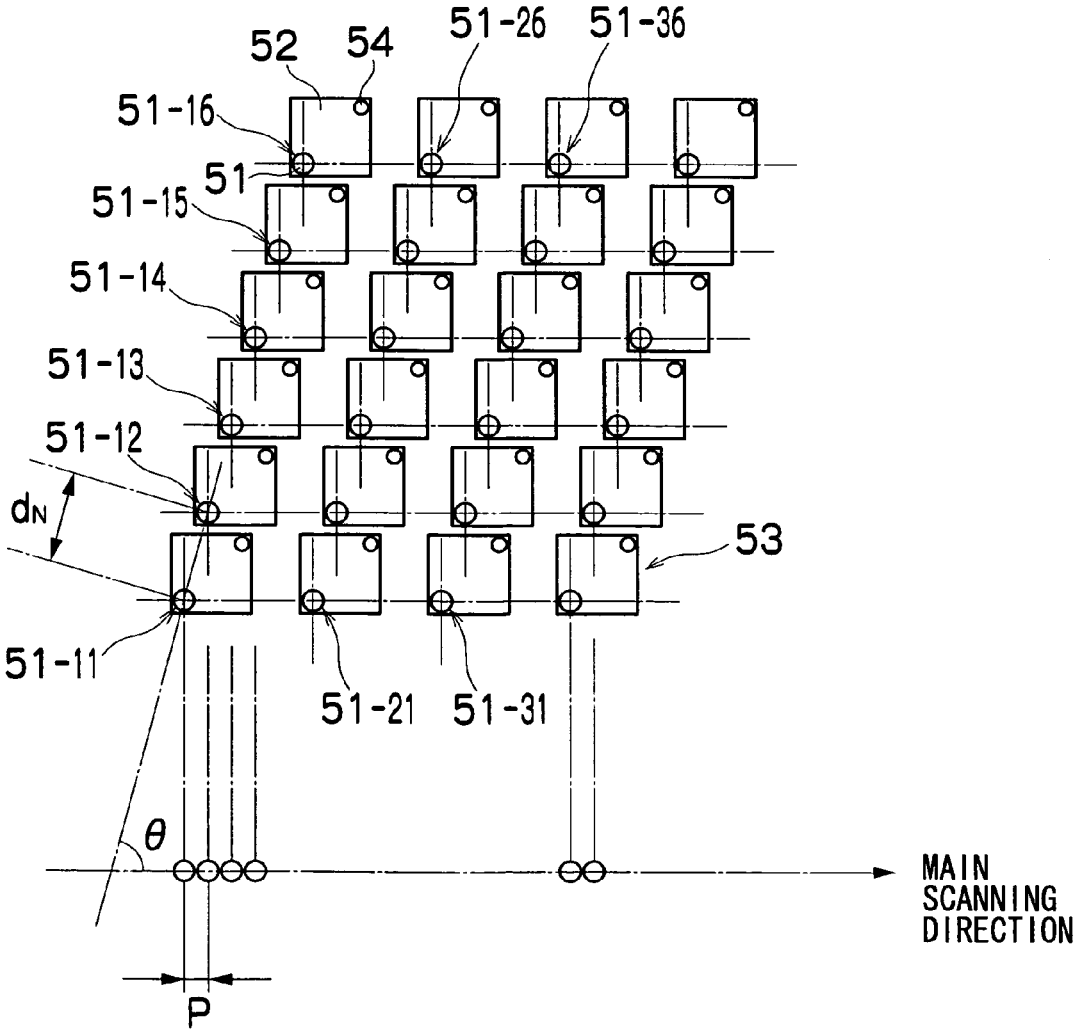
FIG. 5 is an enlarged view showing a nozzle arrangement in the print head shown in FIG. 3A.

As shown in FIG. 5, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch $d_N$ in line with a direction forming an angle of θ with respect to the main scanning direction, the pitch P of the nozzles projected to an alignment in the main scanning direction is $d_N \times \cos\theta$, and hence it is possible to treat the nozzles 51 as if they are arranged linearly at a uniform pitch of P. By adopting a composition of this kind, it is possible to achieve nozzle rows of high density.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording medium (the direction perpendicular to the conveyance direction of the recording medium) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, . . . , 51-26 are treated as another block; the nozzles 51-31, . . . , 51-36 are treated as another block; . . . ); and one line is printed in the width direction of the recording medium by sequentially driving the nozzles 51-11, 51-12, . . . , 51-16 in accordance with the conveyance velocity of the recording medium 16.

On the other hand, "sub-scanning" is defined as to repeatedly perform printing of one line (a line formed of a row of dots, or a line formed of a plurality of rows of dots) formed by the main scanning, while moving the full-line head and the recording medium 16 relatively to each other.

In implementing the present invention, the arrangement of the nozzles is not limited to that of the example illustrated. Moreover, a method is employed in the present embodiment where an ink droplet is ejected by means of the deformation of the actuator 58, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Although not shown here, the structure of the treatment liquid ejection head 11 is approximately the same as the head 50 of the print unit 12 described above. Since the treatment liquid should be applied to the recording medium 16 in a substantially uniform (even) fashion in the region where ink droplets are to be ejected, it is not necessary to form dots to a high density, in comparison with the ink. Consequently, the treatment liquid ejection head 11 may also be composed with a reduced number of nozzles (a reduced nozzle density) in comparison with the print head 50 for ejecting ink. Furthermore, a composition may also be adopted in which the nozzle diameter of the treatment liquid ejection head 11 is greater than the nozzle diameter of the print head 50 for ejecting ink.

Composition of Ink Supply System

Figure 6:
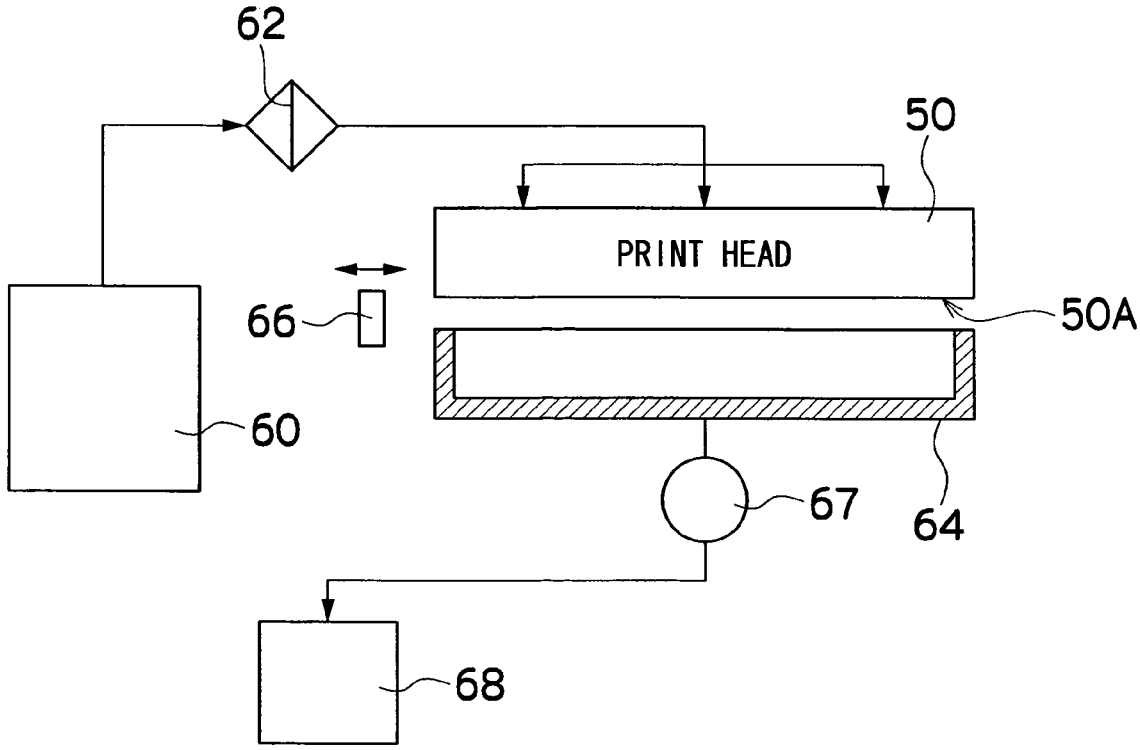
FIG. 6 is a schematic drawing showing the composition of an ink supply system in the inkjet recording apparatus according to the present embodiment.

FIG. 6 is a conceptual diagram showing the composition of an ink supply system in the inkjet recording apparatus 10. In FIG. 6, the ink tank 60 is a base tank for supplying ink to the print head 50, which is disposed in the ink storing and loading unit 14 shown in FIG. 1. In other words, the ink supply tank 60 in FIG. 6 is equivalent to the ink storing and loading unit 14 in FIG. 1. The ink tank 60 may adopt a system for replenishing ink by means of a replenishing port (not shown), or a cartridge system in which cartridges are exchanged independently for each tank, whenever the residual amount of ink has become low. If the type of ink is changed in accordance with the type of application, then a cartridge based system is suitable. In this case, desirably, type information relating to the ink is identified by means of a bar code, or the like, and the ejection of the ink is controlled in accordance with the ink type.

A filter 62 for removing foreign matters and bubbles is disposed between the ink tank 60 and the head 50 as shown in FIG. 6. The filter mesh size in the filter 62 is preferably equivalent to or less than the diameter of the nozzle. Although not shown in FIG. 6, it is preferable to provide a sub-tank integrally to the head 50 or nearby the head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face 50A. A maintenance unit (restoring device) including the cap 64 and the cleaning blade 66 can be relatively moved with respect to the head 50 by a movement mechanism (not shown), and is moved from a predetermined holding position to a maintenance position below the head 50 as required.

The cap 64 is displaced up and down relatively with respect to the head 50 by an elevator mechanism (not shown). When the power of the inkjet recording apparatus 10 is turned OFF or when in a print standby state, the cap 64 is raised to a predetermined elevated position so as to come into close contact with the head 50, and the nozzle face 50A is thereby covered with the cap 64.

The cleaning blade 66 is composed of rubber or another elastic member, and can slide on the nozzle surface 50A (nozzle plate surface) of the print head 50 by means of a blade movement mechanism (not shown). If there are ink droplets or foreign matter adhering to the nozzle plate surface, then the nozzle plate surface is wiped clean by causing the cleaning blade 66 to slide over the nozzle plate.

During printing or during standby, if the use frequency of a particular nozzle has declined and the ink viscosity in the vicinity of the nozzle has increased, then a preliminary ejection is performed onto the cap 64 (which also serves as an ink receptacle), in order to remove the degraded ink.

When a state in which ink is not ejected from the head 50 continues for a certain amount of time or longer, the ink solvent in the vicinity of the nozzles 51 evaporates and ink viscosity increases. In such a state, ink can no longer be ejected from the nozzle 51 even if the actuator 58 for the ejection driving is operated. Before reaching such a state (in a viscosity range that allows ejection by the operation of the actuator 58) the actuator 58 is operated to perform the preliminary discharge to eject the ink of which viscosity has increased in the vicinity of the nozzle toward the ink receptor. After the nozzle surface is cleaned by a wiper such as the cleaning blade 66 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

On the other hand, if air bubbles become intermixed into the nozzle 51 or pressure chamber 52, or if the rise in the viscosity of the ink inside the nozzle 51 exceeds a certain level, then it may not be possible to eject ink in the preliminary ejection operation described above. In cases of this kind, a cap 64 forming a suction device is pressed against the nozzle surface 50A of the print head 50, and the ink inside the pressure chambers 52 (namely, the ink containing air bubbles of the ink of increased viscosity) is suctioned by a suction pump 67. The ink suctioned and removed by means of this suction operation is sent to a recovery tank 68. The ink collected in the recovery tank 68 may be used, or if reuse is not possible, it may be discarded.

Since the suctioning operation is performed with respect to all of the ink in the pressure chambers 52, it consumes a large amount of ink, and therefore, desirably, preliminary ejection is carried out while the increase in the viscosity of the ink is still minor. The suction operation is also carried out when ink is loaded into the print head 50 for the first time, and when the head starts to be used after being idle for a long period of time.

The supply system for the treatment liquids is not shown, but it is the same as the composition of the ink supply system shown in FIG. 6.

Description of Control System

Figure 7:
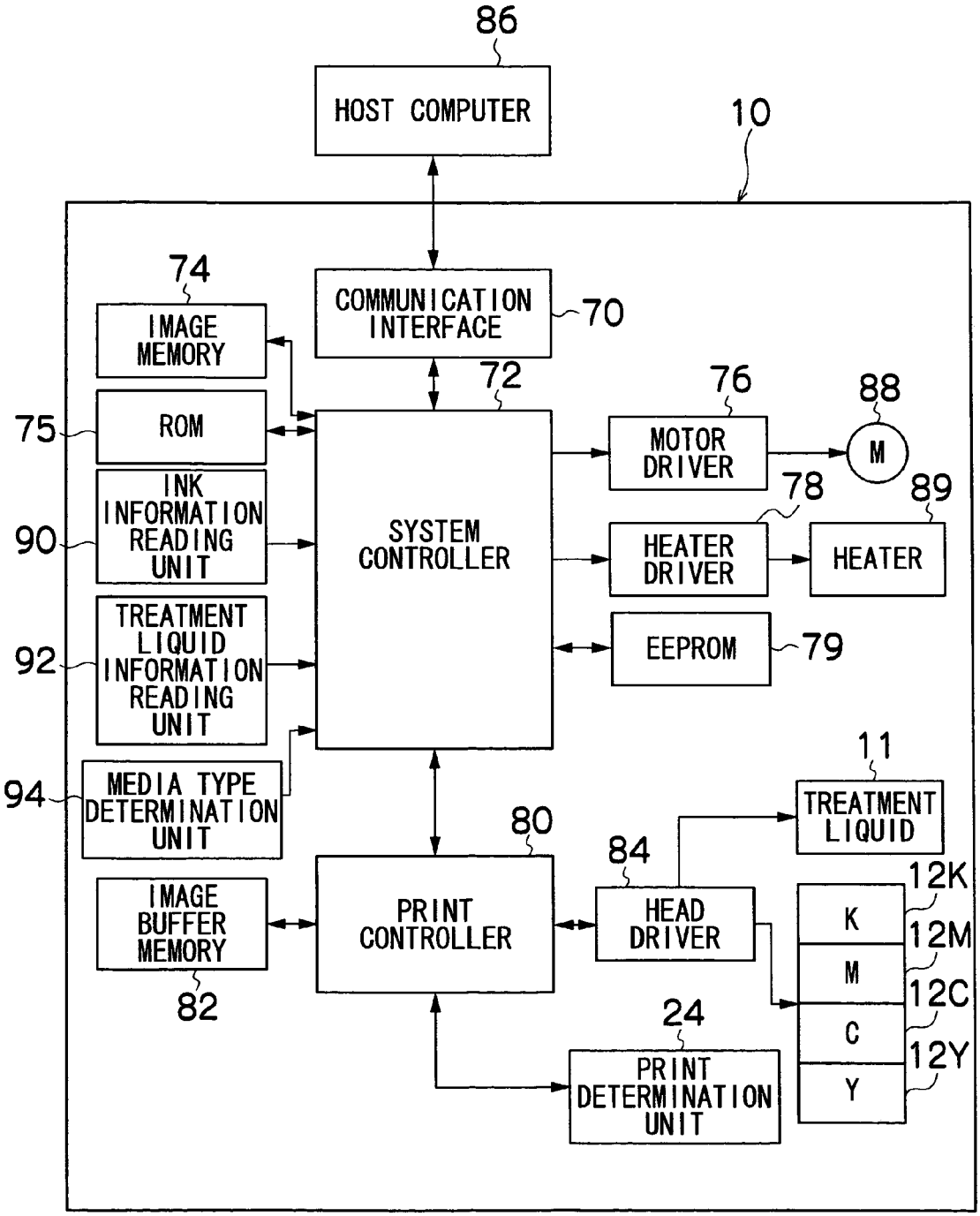
FIG. 7 is a principal block diagram showing the system composition of an inkjet recording apparatus according to the present embodiment.

FIG. 7 is a principal block diagram showing the system configuration of the inkjet recording apparatus 10. The inkjet recording apparatus 10 comprises a communication interface 70, a system controller 72, an image memory 74, a ROM 75, a motor driver 76, a heater driver 78, EEPROM (corresponding to liquid volume ratio control device), a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, and the like, as well as controlling communications with the host computer 86 and writing and reading to and from the image memory 74, ROM 75 and EEPROM 79, and it also generates control signals for controlling the motor 88 and heater 89 of the conveyance system.

The ROM 75 stores a program to be executed by the CPU of the system controller 72, and various data required for control operations (including data for printing a bleeding evaluation test pattern described hereinafter), and the like. The ROM 75 may be a non-rewriteable storage device, or it may be a rewriteable storage device, such as an EEPROM. The image memory 74 is used as a temporary storage region for the image data, and it is also used as a program development region and a calculation work region for the CPU.

The motor driver (drive circuit) 76 drives the motor 88 of the conveyance system in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print data (dot data) to the head driver 84.

The image buffer memory 82 is provided in the print controller 80, and image data, parameters, and other data are temporarily stored in the image buffer memory 82 when image data is processed in the print controller 80. FIG. 7 shows a mode in which the image buffer memory 82 is attached to the print controller 80; however, the image memory 74 may also serve as the image buffer memory 82. Also possible is a mode in which the print controller 80 and the system controller 72 are integrated to form a single processor.

The image data to be printed is externally inputted through the communications interface 70, and is stored in the image memory 74. At this stage, RGB image data is stored in the image memory 74, for example.

The image data stored in the image memory 74 is sent to the print controller 80 through the system controller 72, and is converted to the dot data for each ink color by a half-toning technique, such as dithering or error diffusion, in the print controller 80. In this inkjet recording apparatus 10, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal gradations of the image (namely, the light and shade toning of the image) as faithfully as possible.

In other words, the print controller 80 performs processing for converting the input RGB image data into dot data for the four colors of K, C, M and Y. Furthermore, the print controller 80 judges the droplet ejection region of the treatment liquid (the region of the recording surface where ejection of treatment liquid is required) on the basis of the dot data of the respective colors, and thus generates dot data for the ejection of treatment liquid droplets. The dot data (for the treatment liquid and the respective colors) generated by the print controller 80 is stored in the image buffer memory 82.

The head driver 84 generates drive control signals for the treatment liquid ejection head 11 and the print heads 12K, 12C, 12M and 12Y of the respective ink colors, on the basis of the print data supplied from the print controller 80 (in other words, the dot data stored in the image buffer memory 82). By supplying the drive control signals generated by the head driver 84 to the actuators 58 of the treatment liquid ejection head 11 and the actuators 58 of the print heads 12K, 12C, 12M and 12Y of the respective color inks, treatment liquid is ejected from the corresponding nozzles 51 of the treatment liquid ejection head 11, and ink is ejected from the corresponding nozzles 51 of the print heads 12K, 12C, 12M and 12Y. A feedback control system for maintain uniform driving conditions in the head may also be incorporated into the head driver 84.

By controlling the ejection of treatment liquid from the treatment liquid ejection head 11 and the ejection of ink from the print heads 12K, 12C, 12M and 12Y in synchronism with the conveyance speed of the recording medium 16, an image is formed on the recording medium 16. As described above, prescribed signal processing is carried out in the print controller 80, and the ejection of the treatment liquid, and the ejection amount and the ejection timing of the ink droplets are controlled via the head driver 84, on the basis of the print data. By this means, prescribed dot size and dot positions can be achieved.

As shown in FIG. 1, the print determination unit 24 is a block including an image sensor, which reads in the image printed onto the recording medium 16, performs various signal processing operations, and the like, and determines the print situation (presence/absence of discharge, variation in droplet ejection, optical density, and the like), these determination results being supplied to the print controller 80.

As and when necessary, the print controller 80 performs various corrections relating to the print heads 12K, 12C, 12M and 12Y, on the basis of the information obtained by the print determination unit 24. Furthermore, the system controller 72 implements control (details of which are described hereinafter) for adjusting the volume ratio of the treatment liquid and the ink, on the basis of the information obtained from the print determination unit 24, as well as implementing prescribed restoration processes, such as preliminary ejection, suction, and the like.

Moreover, the inkjet recording apparatus 10 according to this embodiment has an ink information reading unit 90, a treatment liquid information reading unit 92 and a media type determination unit 94. The ink information reading unit 90 is a device for reading in information relating to the ink type. More specifically, it is possible to use, for example, a device which reads in ink identification information or ink properties information from the shape of the cartridge in the ink tank 60 (see FIG. 6) (a specific shape which allows the ink type to be identified), or from a bar code or IC chip incorporated into the cartridge. Besides this, it is also possible for an operator to input the required information by means of a user interface.

Similarly, the treatment liquid information reading unit 92 is a device for acquiring information relating to the type of treatment liquid. More specifically, it is possible to use, for example, a device which reads in identification information or properties information relating to the treatment liquid from the shape of the cartridge in the treatment liquid tank (a specific shape which allows the liquid type to be identified), or from a bar code or IC chip incorporated into the cartridge. Besides this, it is also possible for an operator to input the required information by means of a user interface.

The media type determination unit 94 is a device for determining the type and size of the recording medium. This unit uses, for example, a device for reading in information (identification information or media type information) from a bar code attached to the magazine 19 in the media supply unit 18 shown in FIG. 1, or sensors disposed at a suitable position in the paper conveyance path (a media width determination sensor, a sensor for determining the thickness of the media, a sensor for determining the reflectivity of the media, and so on). A suitable combination of these elements may also be used. Furthermore, it is also possible to adopt a composition in which information relating to the paper type, size, or the like, is specified by means of inputs made via a prescribed user interface, instead of or in conjunction with such automatic determination devices.

The information acquired from the various devices, namely, the ink information reading unit 90, the treatment liquid information reading unit 92 and the media type determination unit 94 shown in FIG. 7 is sent to the system controller 72, where it is used to control the optimal volume ratio of the treatment liquid and the ink, and to control ejection of the ink (namely, the ejection volume and ejection timing), in such a manner that suitable droplet ejection is performed in accordance with the conditions.

As described in detail below, when the conditions of the optimal liquid volume ratio are determined by reading in the print results of a bleeding evaluation test pattern (namely, a test pattern for judging image quality), then this information is stored in the EEPROM 79, together with the media type information. In FIG. 7, the EEPROM 79 and the ROM 75 are depicted as separate blocks, but these may also be formed by a single EEPROM (non-volatile storage device).

Next, a method for determining the conditions of the optimal volume ratio of the treatment liquid and the ink will be described. Consequently, firstly, an example of creating a bleeding evaluation test pattern will be described. As a test pattern, for example, the droplet ejection conditions of the treatment liquid are varied between a number of patterns, and a plurality of lines having various liquid volume ratios are printed by ejecting droplets of ink onto the treatment liquid patterns, under prescribed conditions.

Figure 8:
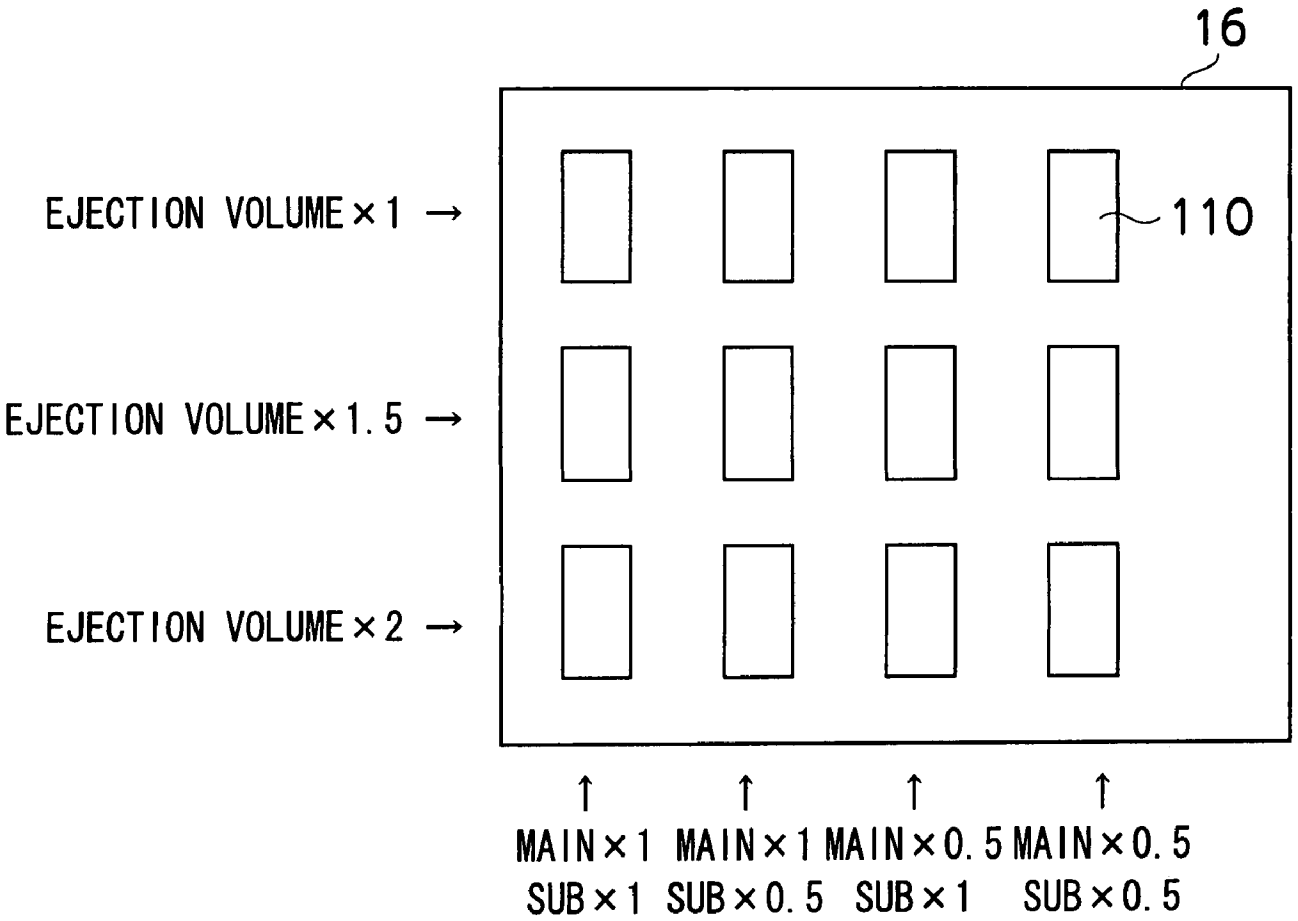
FIG. 8 is a diagram showing an example of droplet ejection of a treatment liquid in a bleeding evaluation test pattern created by the inkjet recording apparatus according to the present embodiment.

FIG. 8 is a diagram showing an example of droplet ejection of a treatment liquid in a bleeding evaluation test pattern created by the inkjet recording apparatus 10 according to the present embodiment.

By varying the combination of the drive waveform and drive frequency of the nozzles, and the number of nozzles used (ejection nozzle pitch) in the treatment liquid ejection head 11 which ejects treatment liquid (see FIG. 1), standard square patterns (hereafter, called "treatment liquid patterns") 110 are formed, each having different ejection volumes, droplet ejection intervals in the sub-scanning direction, and droplet ejection intervals in the main scanning direction, as shown in FIG. 8.

In the example shown in FIG. 8, the ejection volume of the treatment liquid is changed in three steps (2 pl, 3 pl, 4 pl, for instance), and the droplet ejection intervals in the sub-scanning direction and the main scanning direction are changed in two steps respectively (equivalent to 2400 dpi and 1200 dpi, for example), and hence 3×2×2=12 patterns are generated.

In order to change the ejection volume of the treatment liquid, the drive waveform of the actuators provided corresponding to the nozzles of the treatment liquid ejection head 11 is changed. Taking the minimum ejection volume (here, 2 pl) as the unit of ejection volume, ejection is varied between "ejection volume×1" (=2 pl), "ejection volume×1.5" (=3 pl), and "ejection volume×2" (=4 pl).

In order to change the droplet ejection interval in the sub-scanning direction, the drive frequency is altered. The conveyance speed of the recording medium 16 is uniform. Taking the minimum droplet ejection interval (the droplet ejection interval which can be achieved at maximum drive frequency) as a reference, the ejection interval is changed between "sub×1" (which in this case corresponds to 2400 dpi), and "sub×0.5" (which in this case corresponds to 1200 dpi).

In order to change the droplet ejection interval in the main scanning direction, the number of nozzles used is altered. Taking the minimum droplet ejection interval (the droplet ejection interval which can be achieved when using the maximum number of nozzles) as a reference, the ejection interval is changed between "main×1" (which in this case corresponds to 2400 dpi), and "main×0.5" (which in this case corresponds to 1200 dpi).

In this way, 12 treatment liquid patterns 110 are formed by varying the droplet ejection conditions. Desirably, this plurality of treatment liquid patterns 110 are ejected in a matrix alignment on one sheet of recording medium 16.

Figure 9:
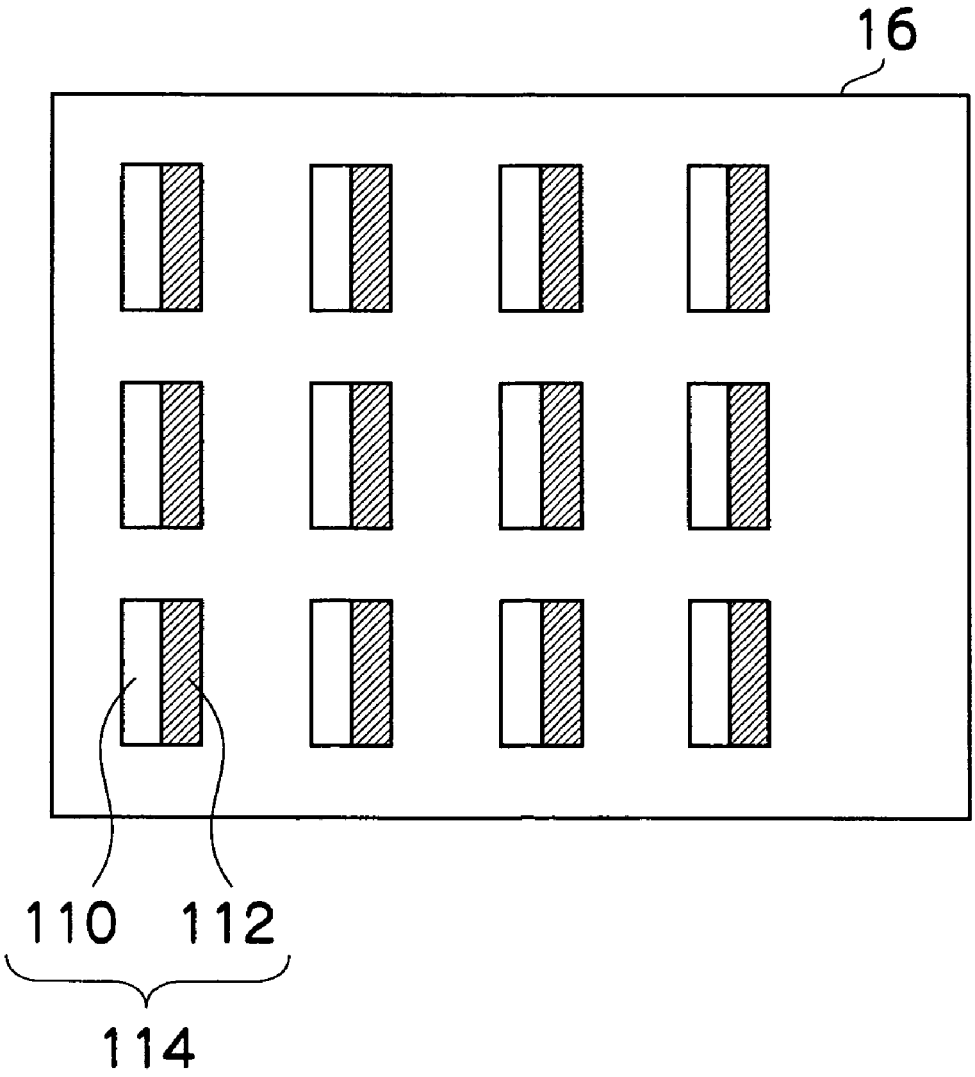
FIG. 9 is a diagram showing an example of droplet ejection of ink (recording liquid) applied onto the patterns of treatment liquid shown in FIG. 8.

Subsequently, as shown in FIG. 9, rectangular patterns (hereinafter, called "recording liquid patterns") 112 are formed by ejecting ink droplets onto the respective treatment liquid patterns 110. In this way, a test pattern 120 is formed containing a plurality of evaluation patches 114 having different volume ratios of treatment liquid and ink. More specifically, the evaluation patches 114 are patterns formed by ejecting droplets of ink onto the treatment liquid patterns 110, and in the present embodiment, they are square-shaped images which can be treated as line segments of a uniform length.

In the present embodiment, the recording liquid patterns 112 are ejected under prescribed conditions with respect to the ink color used, the ink ejection volume, the droplet ejection interval in the sub-scanning direction and the droplet ejection in the main scanning direction, but similarly to the treatment liquid patterns 110, it is also possible to vary the droplet ejection conditions for the ink droplets. In this case, the number of treatment liquid patterns 110 created is increased in accordance with the increase in the droplet ejection conditions.

Furthermore, the present embodiment shows an example in which droplets of ink of only one color are ejected onto any one treatment liquid pattern 110, but it is also possible to eject droplets of inks of a plurality of colors onto the same treatment liquid pattern 110.

Figure 10:
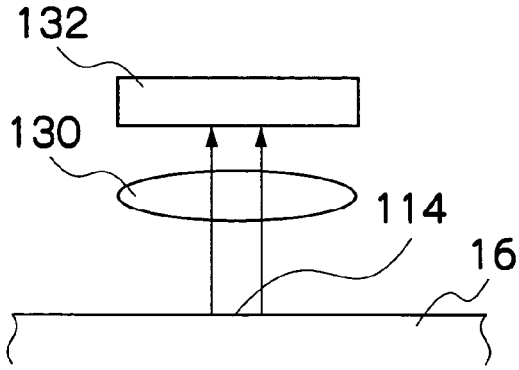
FIG. 10 is a schematic drawing showing the principle of reading in a test pattern.

FIG. 10 is a schematic drawing showing the principles of the determination process performed by a print determination unit 24 (see FIGS. 1 and 7) which reads in the test patterns 120. The print determination unit 24 shown in FIGS. 1 and 7 is constituted by an image forming optical system 130 and a CCD image sensor 132, as shown in FIG. 10, and it functions as a device for measuring the optical density of the print results on the recording medium 16 (a so-called "CCD densitometer"). In other words, the evaluation patches 114 printed onto the recording medium 16 are illuminated with an illumination light source (not shown), and the light reflected by the patches is condensed by the image forming optical system 130 and is received by the CCD image sensor 132.

The captured image formed on the light-receiving surface of the CCD image sensor 132 (in this case, an image of the evaluation patch 114) is converted into an electrical signal corresponding to the incident light quantities, by the photoreceptor elements (not shown) of the CCD image sensor 132, and is output as an image signal from the CCD image sensor 132. By performing image processing to convert the image signal obtained via the CCD image sensor 132 into a digital signal, the line quality is converted into numerical values and the image quality can be evaluated.

Figure 11:
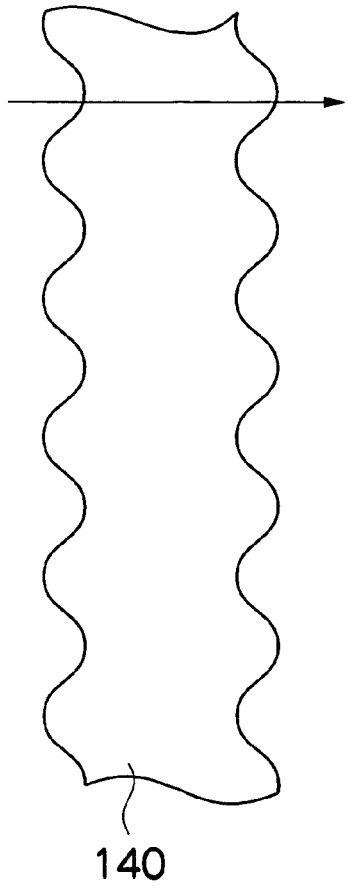
FIG. 11 is an enlarged diagram showing one example of an image obtained by capturing an image of lines of an evaluation patch.

FIG. 11 shows an enlarged view of one example of an image (determination image) obtained by capturing an image of the lines of evaluation patches 114 by means of a CCD image sensor 132. In this diagram, for the sake of convenience, the distorted state of the outlines of the line images in the evaluation patches 114, caused by bleeding of the ink, is depicted in exaggerated form in comparison with a real state.

From the data obtained from the determination image 140, quality attributes such as A: Width, B: Blur, C: Rag, D: Contrast, E: Darkness, and F: Fill, are determined. The method of determining numerical values for these items conforms to ISO 13660, for example.

Figure 12:
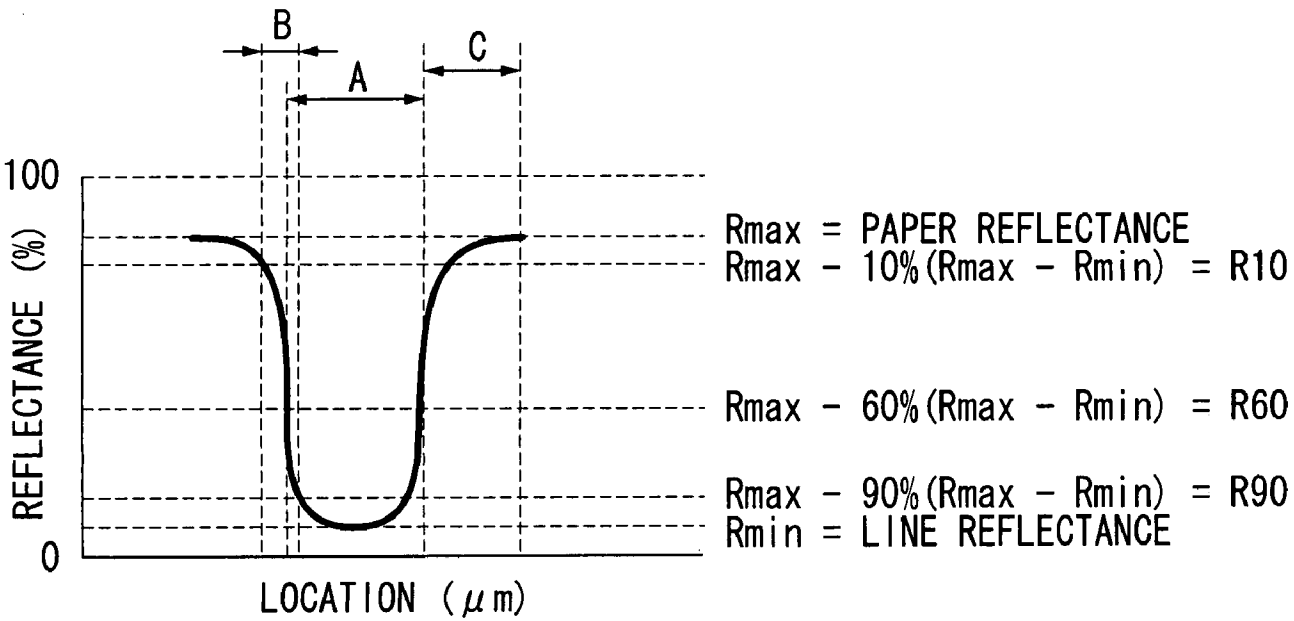
FIG. 12 is a diagram for describing a method of measuring quality attributes.

Here, the method of measuring the quality attributes based on ISO 13660 will be described generally. FIG. 12 is a graph showing an example of density measurement results obtained by measuring in a direction (the direction indicated by the arrow in FIG. 11) perpendicular to the lines which are to be inspected (in this case, the lines of the evaluation patches). The horizontal axis indicates the measurement position (location: unit (μm), and the vertical axis indicates optical reflectance (unit (%)).

The maximum value Rmax of the graph shown in FIG. 12 is the reflectance of the recording medium 16 itself. Furthermore, the minimum value Rmin indicates the reflectance in the section of maximum density of the lines. Moreover, the value RK is defined by subtracting K % of the difference between the maximum value Rmax and the minimum value Rmin, from the maximum value Rmax. In other words, R10, R60, R75, R90 and R95 are respectively defined as follows:

$$R\max-0.1\times(R\max-R\min)=R10;$$

$$R\max-0.6\times(R\max-R\min)=R60;$$

$$R\max-0.75\times(R\max-R\min)=R75;$$

$$R\max-0.9\times(R\max-R\min)=R90;\text{ and}$$

$$R\max-0.95\times(R\max-R\min)=R95.$$

The A value (Width) is the distance between the R60 positions on either side of the line (width A in FIG. 12).

The B value (Blur) is the distance between the R10 and the R90 positions (width B in FIG. 12).

The C value (Rag) is the standard deviation of the divergence from the fitting line at R60.

The D value (Contrast) is defined by (Rmax−Rmin)/Rmax.

The E value (Darkness) is taken as the average optical density within the region contained by the R75 values.

The F value (Fill) is defined by (surface area of R75 and above)/(total surface area of R95 or less).

In the present embodiment, the evaluation value Q is taken to be the sum of the products obtained by multiplying the measurement values A to F converted to numerical values, by respective weighting coefficients a to f as follows:

$$Q=a\times A+b\times B+c\times C+d\times D+e\times E+f\times F.$$

Here, the higher the evaluation value Q, the better the image quality, including sign shifts. The conditions corresponding to the pattern (patch) which produced the maximum value for the evaluation value Q are judged to be the optimal conditions.

In practice, it is desirable to carry out measurement a plurality of times with respect to the determination image 140 shown in FIG. 11, while changing the measurement position in the lengthwise direction of the lines (the up/down direction in FIG. 11). For example, by carrying out measurement a prescribed number of times (at least ten or more times), taking the scanning resolution in the lengthwise direction of the lines to be an interval of several μm to several ten μm, and then finding the average value of the plurality of measurement results thus obtained, a reflectance profile such as that shown in FIG. 12 is obtained. Alternatively, it is also possible to calculate an evaluation value Q for each measurement operation, and then determine the average of these evaluation values.

Desirably, the weighting coefficients a to f are set variably in accordance with the required quality of the output image. For example, if the apparatus is composed in such a manner that a plurality of quality modes can be selected, such as a "text mode" for printing mainly text data, a "text and image mode" for printing a combination of text and images, and an "image mode" for printing mainly images, then since the required image quality varies depending on the selected image mode, the respective coefficients a to f are specified in such a manner that the quality elements required in accordance with the selected image mode are emphasized. For instance, in the case of text mode, in order that the edges are defined distinctly so that the text characters can be read clearly, the various coefficients are set in such a manner that the line width and distortion are emphasized.

In this way, a pattern corresponding to a combination of liquid volumes (volume ratio) which produces the best line quality is selected on the basis of the comparative evaluation of line quality, and the control conditions for treatment liquid ejection and recording liquid ejection are specified in accordance with the conditions relating to this selection.

As described previously in relation to FIG. 1, in the inkjet recording apparatus 10 according to the present embodiment, a composition is adopted in which a treatment liquid ejection head 11 is disposed in the most upstream position of the print unit 12, and before ejecting droplets of ink from the print unit 12, treatment liquid is previously applied to the print surface of the recording medium 16 by means of a single (initial) operation by the preceding treatment liquid ejection head 11. In the case of this composition, it is not possible to perform fine adjustment of the volume of treatment liquid with respect to the different colors, and therefore, a test pattern 120 is printed for only one ink of the four colors, K, C, M and Y, and the optimal liquid ratio is specified on this basis. In this case, desirably, measurement is carried out using the ink of the color having properties which make it most liable to bleeding, among the plurality of colored inks used.

Furthermore, in the inkjet recording apparatus 10 according to the head composition shown in FIG. 1, the amount of treatment liquid on the recording medium 16 gradually declines as the volume of the ink droplets ejected by the print unit 12 increases, and therefore, the further the position toward the downstream side of the print unit 12, the smaller the amount of treatment liquid on the recording medium 16. Since it is necessary for some treatment liquid to be remaining in the vicinity of the surface of the recording medium 16 until droplet ejection by the head in the final stage (furthest downstream position) of the print unit 12 (in FIG. 1, the yellow head 12Y) has been completed, then the amount of treatment liquid ejected by the treatment liquid ejection head 11 is decided on the basis of the type of recording medium 16, the properties of the treatment liquid, the ejected ink volume, the conveyance speed of the recording medium 16, and the like, in such a manner that presence of the required amount of treatment liquid can be ensured.

Figure 13:
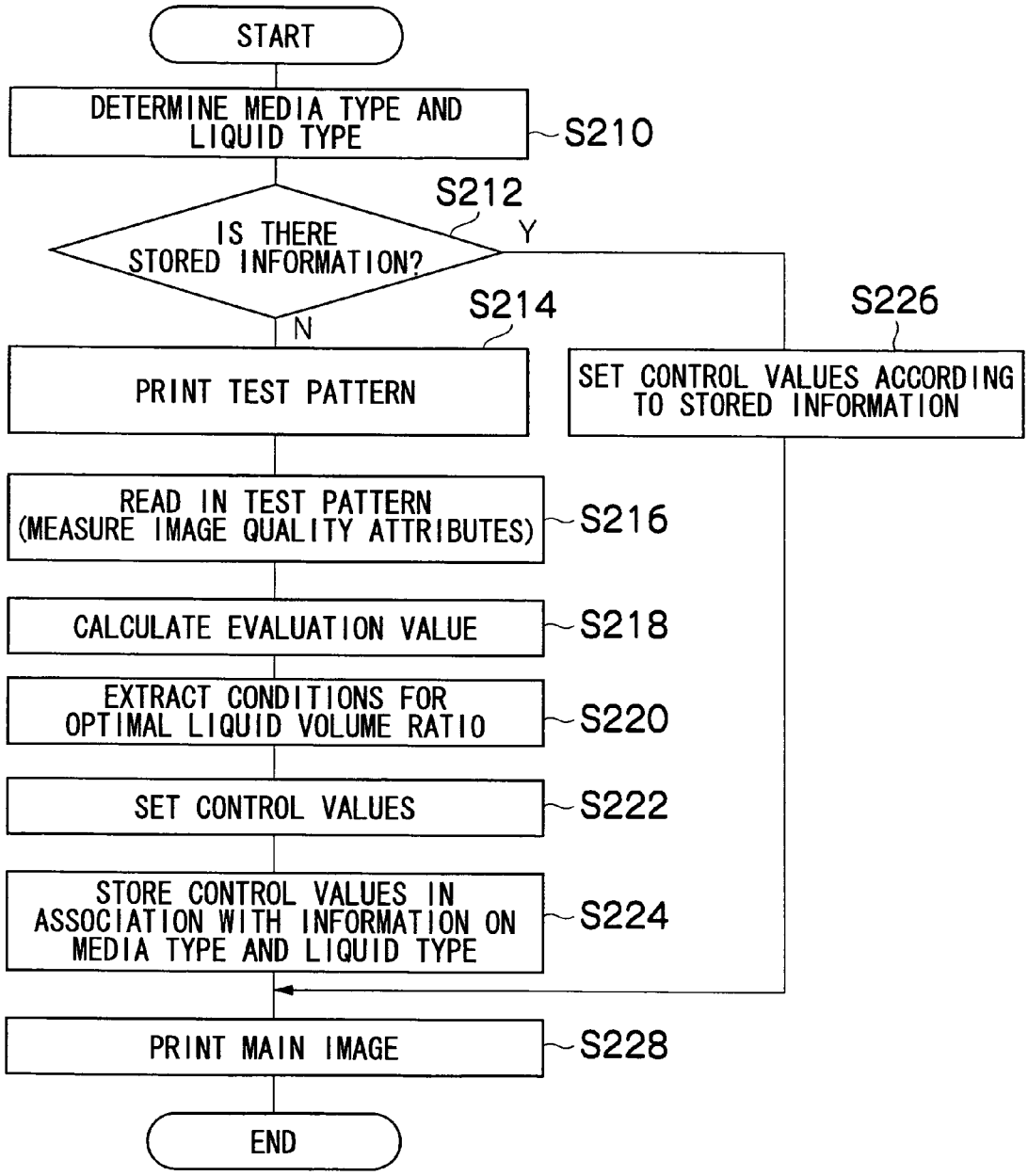
FIG. 13 is a flowchart showing an example of a control procedure in the inkjet recording apparatus relating to the present embodiment.

FIG. 13 is a flowchart showing an example of the control of the inkjet recording apparatus 10 relating to the present embodiment. Firstly, the type of recording medium 16 used, and the type of the treatment liquid and ink are determined (step S210). This process is determined on the basis of the information obtained from the ink information reading unit 90, the treatment liquid information reading unit 92 and the media type determination unit 94 shown in the drawings. As regards the determination timing, determination may be carried out, for example, during the start-up sequence when the power supply is switched on, or when at least one of the media, ink, and/or treatment liquid is replaced (loaded). Alternatively, it may be carried out when at least one of the media type, ink type or treatment liquid type used has been changed.

Next, on the basis of obtained information, and the like, the system controller 72 judges whether or not information relating to the control values which achieve the optimal volume ratio corresponding to the media type, and the like, are stored in the EEPROM 79 (step S212). If there is no corresponding stored information (NO verdict at step S212), then the procedure advances to step S214 in order to carry out a bleeding evaluation test for determining the optimal conditions (step S214).

At step S214, a test pattern 120 is printed by means of the method shown in the drawings. The printed test pattern 120 is read out by the print determination unit 24 (step S216 in FIG. 13), the image quality attributes are measured with respect to the evaluation patches 114, as described above, from the obtained image data, and an evaluation value Q is calculated by means of (formula 6) stated above (step S218).

Of the plurality of evaluation patches 114 in the test pattern 120, the patch producing the maximum value for the evaluation value Q is judged to indicate the optimal conditions (step S220). The ejection volume of the treatment liquid, the droplet ejection frequency and the nozzles used (the treatment liquid ejection density) are decided on the basis of the droplet ejection pattern of the treatment liquid judged to correspond to the optimal conditions, and respective control values are set for these factors (step S222). Furthermore, information relating to the control values for the optimal conditions thus determined is stored in the EEPROM 79, together with information on the media type and the liquid type (step S224).

Droplets of treatment liquid are ejected in accordance with the control values thus established, before ejection of ink droplets for forming the main image, whereupon the target image (main image) is printed by ejecting droplets of ink onto the treatment liquid (step S228). Desirably, the droplet ejection range of the treatment liquid is controlled on the basis of image data indicating the image contents that are to be printed.

On the other hand, if the corresponding stored information does exist in the judgment step at S212 (in the case of a YES verdict at step S212), then the procedure advances to step S226, the information stored in the EEPROM 79 is read out, and the corresponding control values are set. Thereupon, the procedure advances to step S228, droplets of treatment liquid and droplets of ink are ejected, and the target image (main image) is thus printed.

According to the control example described above, since optimal control conditions producing little bleeding are set automatically for the ejection of treatment liquid and the ejection of recording liquid, in accordance with the type of recording medium 16 being used, it is possible to achieve high-quality image output (printing), irrespective of the type of media.

Furthermore, once optimal conditions are found by printing a test pattern 120, then by storing the corresponding information in association with the media type information, and thus accumulating condition information corresponding to various types of media, the information thus recorded can be utilized at a later stage, and hence test printing and measurement processing under duplicated conditions can be avoided, while at the same time, the apparatus can respond swiftly to many different types of media.

There may be cases where the ink type and/or the type of treatment liquid are fixed, but desirably, the combination ratio of the treatment liquid and the ink is optimized in accordance with the flowchart shown in FIG. 13 at least when the type of recording medium 16 used has been changed.

Furthermore, the embodiment described above related to an example in which evaluation patches 114 having varying droplet ejection conditions for the treatment liquid are formed and, principally, the droplet ejection conditions of the treatment liquid are controlled, but it is also possible to form evaluation patches having varying droplet ejection conditions in respect of the recording liquid, similarly, and to control the droplet ejection conditions of the recording liquid instead of or in combination with the droplet ejection control relating to the treatment liquid. It is possible to output images of even higher quality by also adjusting the ink volume, in addition to the volume of the treatment liquid.

Furthermore, in the embodiment described above, measurement based on a test pattern is carried out using only one color of ink from the plurality of colored inks, but a mode is also possible in which measurement is made on the basis of test patterns using two or more colors (or using all of the colors), the optimal conditions being established on the basis of these measurements.

If, as a result of the measurements for different colors, the optimal conditions are found to be different for each color, then desirably, emphasis is given to the conditions extracted on the basis of the color which has the highest visibility characteristics (namely, the most conspicuous color).

Furthermore, in FIG. 1, one treatment liquid ejection head 11 is disposed at the most upstream position of the print unit 12 (see FIG. 1), but in implementing the present invention, the method of arranging the treatment liquid ejection head is not limited to this example, and it is also possible to adopt a composition in which a treatment liquid ejection is appended at at least one position between respective color heads in the print unit 12.

For example, in the case of a mode where treatment liquid heads are provided respectively before each color head (on the upstream side thereof), it is possible to adjust the amount of treatment liquid independently, for each respective color. In this case, the printing of the bleeding evaluation test pattern and the measurement process based on reading in the test pattern need only be carried out for one color. For the inks of other colors which have not been measured, the optimal volume ratio with respect to the treatment liquid can be predicted by correcting (adjusting) the results of the measured color, by using a correspondence table. The correspondence table may be created in advance on the basis of experimentation, or the like, and the relevant data stored in a storage device, such as the ROM 75.

Naturally, it is also possible to create test patterns for each color, determine the optimal volume ratio with respect to the treatment liquid for each color, separately, and then control droplet ejection from each of the treatment liquid heads accordingly.

Furthermore, in the respective embodiments described above, an inkjet recording apparatus using a page-wide full line type head having a nozzle row of a length corresponding to the entire width of the media (recording medium) has been described, but the scope of application of the present invention is not limited to this, and the present invention may also be applied to an inkjet recording apparatus using a shuttle head which performs image recording while moving a short recording head reciprocally.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

a first liquid ejection device which ejects droplets of a first liquid;

a second liquid ejection device which ejects droplets of a second liquid; and a liquid volume ratio control device which controls a liquid volume ratio of the first liquid and the second liquid ejected from the first liquid ejection device and the second liquid ejection device, according to an image formed on a recording medium by the droplets of the first liquid and the second liquid on the recording medium, wherein:

the image formed on the recording medium by depositing the droplets of the first liquid and the second liquid is a test pattern; and the image forming apparatus further comprises a test pattern droplet ejection control device which controls ejection of the droplets by the first liquid ejection device and the second liquid ejection device, in such a manner that the test pattern is printed, wherein the test pattern is an image which includes a plurality of evaluation patches in which a droplet ejection volume of at least one of the first liquid and the second liquid is varied.

2. The image forming apparatus as defined in claim 1, wherein the second liquid is a recording liquid including a coloring material, and the first liquid is a treatment liquid having reactivity which causes a change of properties affecting at least one of permeation characteristics of the recording liquid into the recording medium and fixing characteristics of the coloring material onto the recording medium.

3. The image forming apparatus as defined in claim 1, further comprising:

a medium type determination device which determines a type of the recording medium; and a liquid volume ratio storage device which stores information relating to the liquid volume ratio controlled by the liquid volume ratio control device, in association with information relating to the type of the recording medium obtained by the medium type determination device.

4. The image forming apparatus as defined in claim 1, wherein the plurality of evaluation patches are formed by ejecting droplets while varying a combination of ejection drive waveform, ejection drive frequency, and ejection nozzle pitch.

5. The image forming apparatus as defined in claim 1, further comprising:

an image determination device which determines an image formed on the recording medium by ejecting droplets of the first liquid and the second liquid, wherein the liquid volume ratio is controlled by the liquid volume ratio control device according to image determination results obtained by the image determination device.

6. The image forming apparatus as defined in claim 5, further comprising:

an evaluation value calculation device which calculates an evaluation value for judgment purposes by measuring at least two elements from among width, blur, rag, contrast, darkness and fill, from information obtained via the image determination device, and combining measurement results from at least two of the elements, wherein the liquid volume ratio control device specifies the liquid volume ratio according to the evaluation value calculated by the evaluation value calculation device.

7. The image forming apparatus as defined in claim 1, wherein the image formed on the recording medium by depositing the droplets of the first liquid and the second liquid is a test pattern; and the image forming apparatus further comprises a test pattern droplet ejection control device which controls ejection of the droplets by the first liquid ejection device and the second liquid ejection device, in such a manner that the test pattern is printed for different ejection volumes, droplet ejection intervals in a sub-scanning direction, and droplet ejection intervals in a main scanning direction.

8. The image forming apparatus as defined in claim 1, wherein said image is a test image obtained by varying a combination of a drive waveform and a drive frequency of the nozzles and a number of nozzles used for at least one of said first and second liquids.

9. The image forming apparatus as defined in claim 1, wherein:

one of said first and second liquids is an ink and the other is a treatment liquid, and said image includes patterns formed based on an ink color used, an ink ejection volume and a droplet ejection interval, and a treatment liquid ejection volume and treatment liquid droplet ejection interval.

10. The image forming apparatus as defined in claim 1, further comprising:

an image determination device which determines an image formed on the recording medium by ejecting droplets of the first liquid and the second liquid, and an evaluation value calculation device which calculates an evaluation value for judgment purposes by measuring the elements of width, blur, rag, contrast, darkness and fill, from information obtained via the image determination device, and combining measurement results from said elements.

11. The image forming apparatus as defined in claim 10, wherein an evaluation value is obtained using measurement results from said elements together with weighting coefficients.

12. The image forming apparatus as defined in claim 11, wherein said weighting coefficients are set based on a required quality of an output image.

13. The image forming apparatus as defined in claim 1, wherein an evaluation value is obtained based on measurements of width, blur, rag, contrast, darkness and fill associated with said image, and said liquid volume ratio is determined according to said evaluation value.

14. An image forming method, comprising the steps of:

ejecting droplets of a first liquid from a first liquid ejection nozzle;

ejecting droplets of a second liquid from a second liquid ejection nozzle;

determining an image formed on a recording medium by the droplets of the first liquid and the second liquid;

controlling a liquid volume ratio of the first liquid and the second liquid ejected from the first liquid ejection nozzle and the second liquid ejection nozzle, according to image determination results obtained in the image determination step, wherein an image is formed on the recording medium by ejecting droplets of the first liquid and the second liquid from the first liquid ejection nozzle and the second liquid ejection nozzle according to conditions controlled in the liquid volume ratio control step and an input image data, and wherein the image formed on the recording medium by depositing the droplets of the first liquid and the second liquid is a test pattern; and controlling ejection of the droplets by the first liquid ejection nozzle and the second liquid ejection nozzle, in such a manner that the test pattern is printed, wherein the test pattern is an image which includes a plurality of evaluation patches in which a droplet ejection volume of at least one of the first liquid and the second liquid is varied.

15. The image forming method as defined in claim 14, further comprising:

calculating an evaluation value for judgment purposes by measuring at least two elements from among width, blur, rag, contrast, darkness and fill, from information obtained via the determining step, and combining measurement results from at least two of the elements.

16. The image forming method as defined in claim 14, wherein the second liquid is a recording liquid including a coloring material, and the first liquid is a treatment liquid having reactivity which causes a change of properties affecting at least one of permeation characteristics into the recording medium and fixing characteristics of the coloring material onto the recording medium.

17. The image forming method as defined in claim 14, wherein said image is a test image obtained by varying a combination of a drive waveform and drive frequency of the nozzles, and a number of nozzles used for at least one of said first and second liquids.

18. The image forming method as defined in claim 14, further comprising:

calculating an evaluation value for judgment purposes by measuring elements of width, blur, rag, contrast, darkness and fill, from information obtained via the determining step, and combining measurement results from said elements.

* * * * *